US009464457B2

(12) United States Patent
Koyama et al.

(10) Patent No.: US 9,464,457 B2
(45) Date of Patent: Oct. 11, 2016

(54) HANDLE STRUCTURE FOR BI-FOLD DOOR

(75) Inventors: Takashi Koyama, Hiratsuka (JP); Masayuki Fushimi, Tokyo (JP)

(73) Assignee: The Yokohama Rubber Co., LTD. (JP)

( * ) Notice: Subject to any disclaimer, the term of this patent is extended or adjusted under 35 U.S.C. 154(b) by 0 days.

(21) Appl. No.: 14/424,871

(22) PCT Filed: Aug. 30, 2012

(86) PCT No.: PCT/JP2012/005499
§ 371 (c)(1),
(2), (4) Date: Jul. 28, 2015

(87) PCT Pub. No.: WO2014/033787
PCT Pub. Date: Mar. 6, 2014

(65) Prior Publication Data
US 2016/0032615 A1 Feb. 4, 2016

(51) Int. Cl.
*E05B 1/00* (2006.01)
*A47B 95/02* (2006.01)
*E06B 3/48* (2006.01)
*E05B 65/00* (2006.01)

(52) U.S. Cl.
CPC ..... *E05B 1/0015* (2013.01); *E06B 3/481* (2013.01); *E05B 65/0085* (2013.01)

(58) Field of Classification Search
CPC . Y10T 16/458; Y10T 16/462; Y10T 16/498; Y10T 16/513; E05B 1/0015; E05B 1/0053; E05B 1/0063; E05B 1/0084; E05B 5/00; E05B 5/006; E05B 65/08; E05B 2065/0805; A47B 95/02; A47B 2095/023; A47B 2095/026; A47B 2095/027; A47B 2095/024; F25D 23/025; E25D 23/028; E05D 15/264; E05D 15/2662; E05D 2015/268; E06B 3/48; E06B 3/481
See application file for complete search history.

(56) References Cited

U.S. PATENT DOCUMENTS 1,478,381 A * 12/1923 Crimmel ..... A47B 95/02 16/415
2,713,897 A * 7/1955 Teague ..... E05B 1/0015 16/412

(Continued)

FOREIGN PATENT DOCUMENTS

JP S59-019869 2/1984
JP S59-117759 8/1984

(Continued)

OTHER PUBLICATIONS

International Search Report for International Application No. PCT/JP2012/005499 dated Sep. 25, 2012, 4 pages, Japan.

*Primary Examiner* — Chuck Mah
(74) *Attorney, Agent, or Firm* — Thorpe North & Western

(57) ABSTRACT

A handle structure is provided with handles and finger insertion recesses disposed on each of first and second doors. Each handle is provided with a finger-hook plate piece that extends vertically while protruding from the vicinity of one end faces on an outer surface, where first and second doors are bendably joined, toward other end faces. The finger insertion recesses are formed on the outer surfaces of the first and second doors in such a manner as to face the finger-hook plate pieces, and are formed in dimensions that enable fingers to be hooked on inner surfaces of the handles. The handles and the finger insertion recesses are formed in a bilaterally symmetrical shape with the end faces, which face each other, of the doors in the center.

3 Claims, 6 Drawing Sheets

(56) References Cited

U.S. PATENT DOCUMENTS

| | | | | | |
|---|---|---|---|---|---|
| 2,783,494 | A * | 3/1957 | Sterling | E05B 1/0015 | 16/412 |
| 2,904,368 | A * | 9/1959 | Taubman | D06M 13/348 | 16/412 |
| 3,107,389 | A * | 10/1963 | Engelbrecht | A47B 47/00 | 16/416 |
| 3,400,749 | A * | 9/1968 | Smith | E05B 1/0015 | 16/412 |
| 3,648,411 | A * | 3/1972 | Saunders | E05B 1/0015 | 16/412 |
| 3,662,492 | A * | 5/1972 | Bradley | F25D 23/02 | 49/501 |
| 3,676,895 | A * | 7/1972 | Stewart | E05B 1/0015 | 16/412 |
| 3,827,737 | A * | 8/1974 | Rystad | E05C 19/028 | 292/74 |
| 4,586,762 | A * | 5/1986 | Kennedy | A47B 95/02 | 16/412 |
| 4,805,263 | A * | 2/1989 | Kurtz | E05B 1/0015 | 16/443 |
| 5,355,554 | A * | 10/1994 | Magoon | E05B 1/0015 | 16/412 |
| 5,553,354 | A * | 9/1996 | Trulaske, Sr. | A47B 95/02 | 16/412 |
| 5,740,587 | A * | 4/1998 | Onai | A47B 95/02 | 16/412 |
| D442,846 | S * | 5/2001 | Bastian | D8/313 | |
| D501,785 | S * | 2/2005 | Mogus | D8/313 | |
| 2006/0012189 | A1* | 1/2006 | Olivier | E05B 1/0015 | 292/336.3 |
| 2006/0282986 | A1* | 12/2006 | Kim | E05B 1/0015 | 16/412 |
| 2011/0273071 | A1* | 11/2011 | Kim | F25D 23/028 | 312/405 |
| 2013/0019434 | A1* | 1/2013 | Kopp | E04F 11/1802 | 16/110.1 |

FOREIGN PATENT DOCUMENTS

| | | | |
|---|---|---|---|
| JP | H04-100791 | | 8/1992 |
| JP | 11159255 | A * | 6/1999 |
| JP | 2000097552 | A * | 4/2000 |
| JP | 2009-137510 | | 6/2009 |

* cited by examiner

HANDLE STRUCTURE FOR BI-FOLD DOOR

TECHNICAL FIELD

The present technology relates to a handle structure for a bi-fold door.

BACKGROUND

Conventionally, a bi-fold door, in which end faces which are positioned at one end in the width direction of two doors with a rectangular plate shape are bendably joined, and outer surfaces of these doors are folded in a V shape so as to open an opening part, is, for example, used in the entrances to lavatory units for aircrafts.

Then, a handle for an opening and closing operation of the door is provided at a position on the outer surface near the bendably joined end faces.

However, in a conventional handle structure, there is a problem in that it is difficult to intuitively understand whether to push or to pull the bendably joined portion of the bi-fold door simply by looking at the handle.

In addition, depending on the form of the handle, it may be difficult to see whether or not there is a handle. Furthermore, there is also a problem in that either right-handed people or left-handed people may not understand the direction for inserting the fingers with respect to the handle at a glance.

SUMMARY

The present technology has been created in consideration of the above circumstances and the present technology provides a handle structure for a bi-fold door that makes it easy to find a handle; understand the direction in which fingers are to be inserted at a glance; and intuitively understand that the handle is to be pulled.

The present technology provides a handle structure for a bi-fold door in which two doors with a rectangular plate shape having end faces at both ends in a width direction are bendably joined at the one end faces and have outer surfaces positioned on one ends in a thickness direction of the two doors, and the outer surfaces are folded in a V shape at the one end faces so as to open an opening part. In such a handle structure, handles and finger insertion recesses are provided at positions on the outer surfaces near the one end faces. The handles are provided with finger-hook plate pieces which extend vertically while protruding from vicinities of the one end faces on the outer surfaces toward other end faces. The finger insertion recesses are provided on the outer surfaces of the doors so as to face the finger-hook plate pieces. An interval between inner surfaces of the finger-hook plate pieces which face the finger insertion recesses and bottom surfaces of the finger insertion recesses is formed with dimensions which enable fingers to be hooked on the inner surfaces of the finger-hook plate pieces. In a case where the outer surfaces of the doors are viewed from the front, the finger insertion recesses are formed up to positions outside of contours of the finger-hook plate pieces. The handles and the finger insertion recesses provided on the doors are formed in a bilaterally symmetrical shape with the one end faces in the center.

In accordance with the present technology, the two doors which constitute the bi-fold door are each provided with a handle and a finger insertion recess which extends outside the handle.

Accordingly, it is of course easy to find the handle and it is possible to intuitively determine that the handle is to be pulled with the fingers hooked thereto simply by glancing at the handle and the finger insertion recess.

In addition, since the handle and the finger insertion recess in each door are formed to be bilaterally symmetrical, it is possible for both right-handed people and left-handed people to determine the direction in which fingers are to be inserted at a glance.

BRIEF DESCRIPTION OF THE DRAWINGS

FIG. 1A is a diagram illustrating a state where an opening part is closed by the bi-fold door, and FIG. 1B is a diagram illustrating a state where the opening part is open.

FIG. 4A is a diagram illustrating a state where an opening part is closed by the bi-fold door, and FIG. 4B is a diagram illustrating a state where the opening part is open.

DETAILED DESCRIPTION OF THE TECHNOLOGY

The following is a description of an embodiment of the present technology applied to a bi-fold door which constitutes an entrance to a lavatory unit for an aircraft.

First, description will be given of a first embodiment while referring to FIGS. 1A to 3B.

Figure 1B:
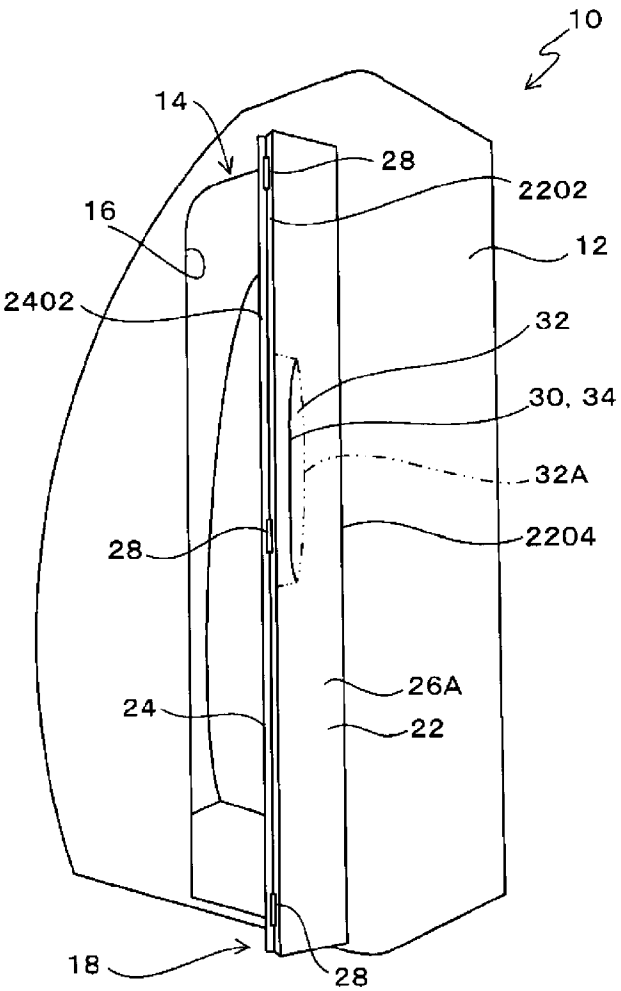
FIGS. 1A and 1B are perspective views of a lavatory unit for an aircraft to which a handle structure of a bi-fold door of a first embodiment is applied.
Figure 1A:
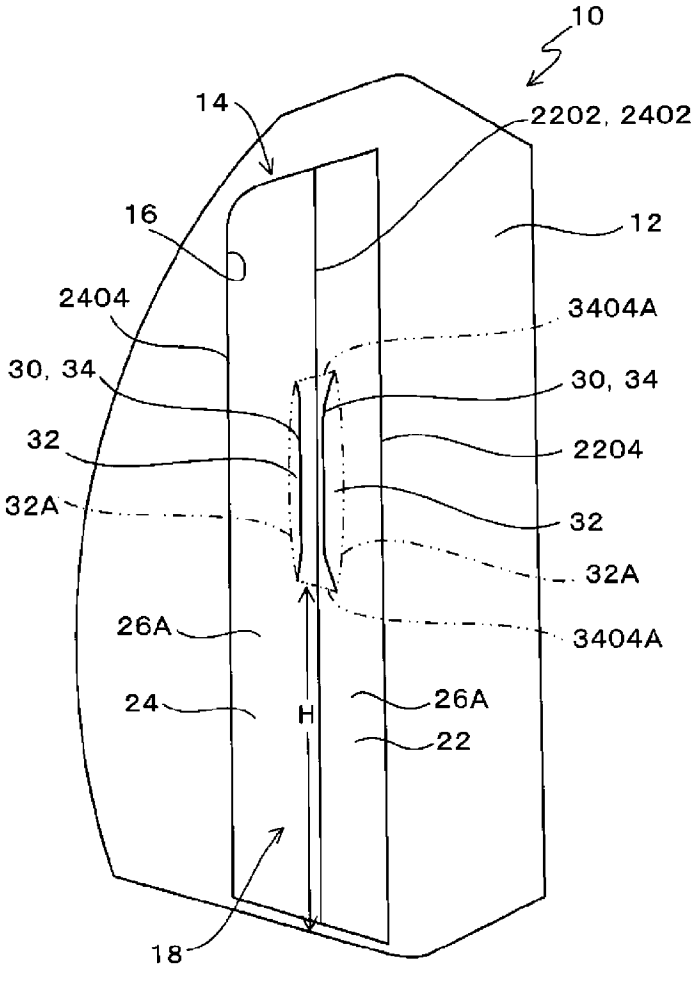

As illustrated in FIGS. 1A and 1B, a lavatory unit 10 is provided with a structural frame 12, and the lavatory unit 10 is formed by arranging a toilet and a wash basin inside the structural frame 12.

An entrance 14 is provided in the structural frame 12. The entrance 14 is constituted by an opening part 16 and a bi-fold door 18 which opens and closes the opening part 16.

The bi-fold door 18 is constituted by a first door 22 and second door 24 with a vertically long rectangular plate shape. The first and second doors 22, 24 have outer surfaces 26A which are positioned outside the lavatory unit 10 and inner surfaces 26B which are positioned inside the lavatory unit 10 in a state where the opening part 16 is closed. The outer surfaces 26A and the inner surfaces 26B form both surfaces of the first and second doors 22, 24 in the thickness direction.

The first door 22 and the second door 24 respectively have end faces 2202, 2204, and 2402, 2404 which are positioned on both ends in the width direction of the doors and extend vertically.

The one end face 2202 of the first door 22 and the one end face 2402 of the second door 24 are bendably joined via a hinge 28 and configured so as to open the opening part 16 by the outer surfaces 26A of the first and second doors 22, 24 being folded in a V shape.

The one end faces 2202, 2402 face each other in a state where the opening part 16 is closed as illustrated in FIG. 1A and face the outside of the lavatory unit 10 in a state where the opening part 16 is open as illustrated in FIG. 1B.

The other end face 2204 of the first door 22 is bendably joined via a hinge to the portion of the structural frame 12 on one side of the opening part 16, and an appropriate position of an upper edge portion of the second door 24 is movably joined to a guide rail which is provided on the portion of the structural frame 12 on the upper side of the opening part 16.

The other end face 2404 of the second door 24 is fitted to the frame 12 in a state where the opening part 16 is closed and faces the inside of the lavatory unit 10 in a state where the opening part 16 is open.

The handle structure of the first embodiment is provided with handles 30 and finger insertion recesses 32 which are provided in each of the first and second doors 22, 24 which are the two doors.

The handles 30 are respectively provided at positions on the outer surfaces 26A near the one end faces 2202, 2402.

The handles 30 are each provided with a finger-hook plate piece 34 which extends vertically while protruding from the vicinity of the respective one end face 2202, 2402 on the outer surface 26A toward the respective other end face 2204, 2404. That is, the handles 30 are provided with the finger-hook plate pieces 34 which extend vertically while protruding from ends on the outer surface 26A of the one end faces 2202, 2402 toward the other end faces 2204, 2404 in an inclined direction with respect to the outer surfaces 26A.

Figure 3A:
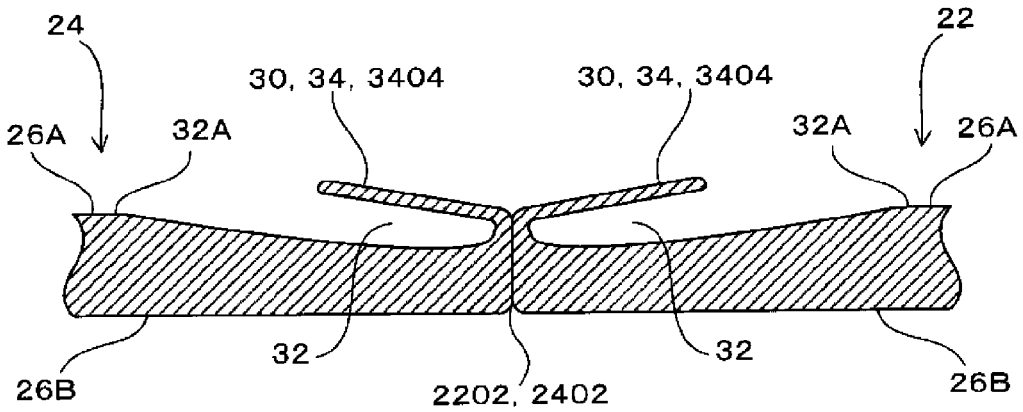
FIG. 3A is a cross-sectional view along a line A-A in FIG. 2B.
Figure 3B:
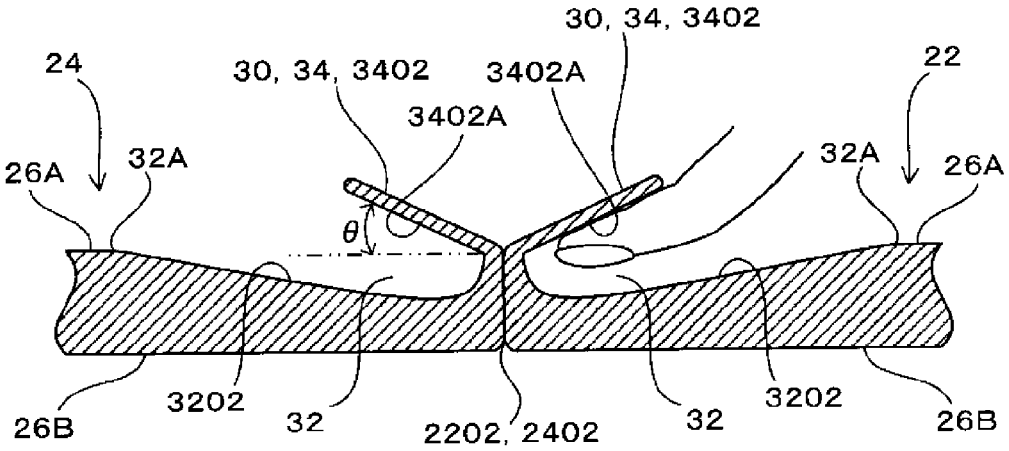
FIG. 3B is a cross-sectional view along a line B-B in FIG. 2B.

In more detail, as illustrated in FIG. 3B, intermediate portions excluding upper and lower ends of the finger-hook plate pieces 34 are formed by inclined plate portions 3402 which have a fixed inclination angle θ with respect to the outer surfaces 26A, extend vertically with a fixed width W, and incline away from the outer surfaces 26A as the inclined plate portions 3402 extend away from the end faces 2202, 2402.

Figure 2A:
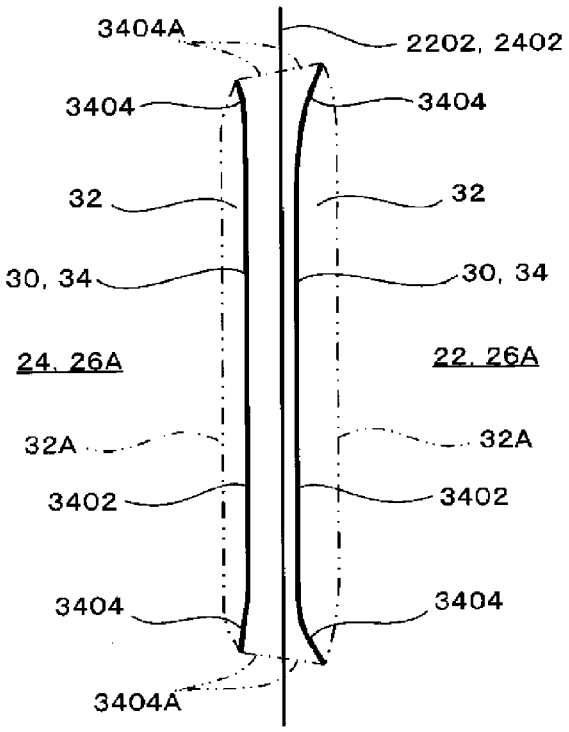
FIG. 2A is an enlarged perspective view of handles and finger insertion recess portions.
Figure 2B:
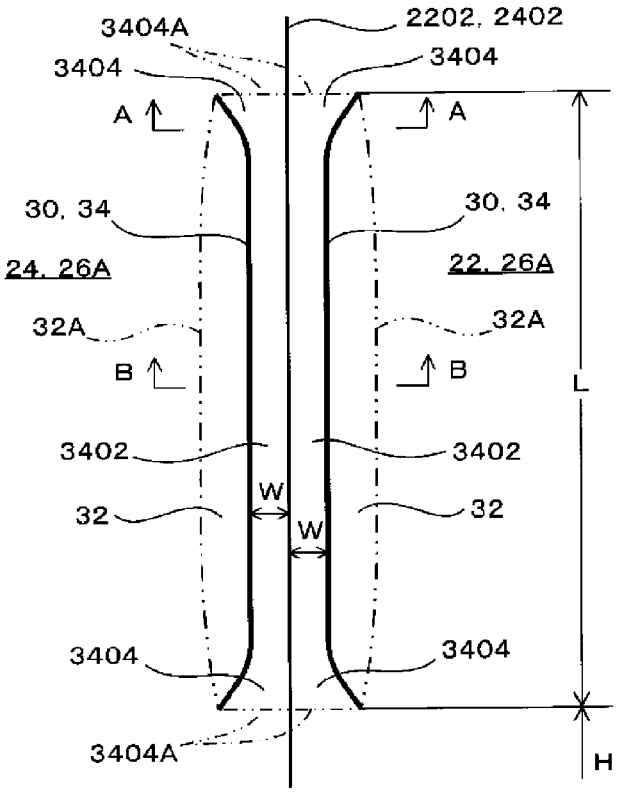
FIG. 2B is a front view of the handles and the finger insertion recess portions.

As illustrated in FIG. 3A, the upper and lower ends of the finger-hook plate pieces 34 are formed by connecting plate portions 3404 which are gradually erected from the outer surfaces 26A and are connected with the inclined plate portions 3402. Note that the reference numerals 3404A in FIGS. 1A to 2B indicate positions of the starting point at which the connecting plate portions 3404 are erected from the outer surfaces 26A.

On the other hand, the finger insertion recesses 32 are formed on the outer surfaces 26A of the first and second doors 22, 24 so as to face the finger-hook plate pieces 34.

In the intermediate portions excluding upper and lower ends of the finger insertion recesses 32, an interval between inner surfaces 3402A of the inclined plate portions 3402 which are positioned to face the finger insertion recesses 32 and bottom surfaces 3202 of the finger insertion recesses 32 is formed with dimensions which enable fingers to be inserted on the inner surfaces 3402A of the inclined plate portions 3402 and to be hooked on the inner surfaces 3402A of the inclined plate portions 3402 as illustrated in FIG. 3B. In such a case, enabling the fingers to be hooked means enabling a portion of the fingers from at least the tips of the fingers to the second joints thereof to be hooked.

The upper and lower ends of the finger insertion recesses 32 are formed with shapes which are gradually hollowed from the outer surfaces 26A and connect with the intermediate portions. Note that, in the diagrams, the reference numerals 32A indicate positions of the starting points at which the finger insertion recesses 32 start to be hollowed out from the outer surfaces 26A.

Then, in a case where the outer surfaces 26A of the first and second doors 22, 24 are viewed from the front, the finger insertion recesses 32 are formed up to positions outside of the contours of the finger-hook plate pieces 34 as illustrated in FIG. 2B.

The handles 30 and the finger insertion recesses 32 are formed in a bilaterally symmetrical shape with the one end faces 2202, 2402 in the center.

In the present embodiment, as illustrated in FIG. 1A and FIG. 2B, the handles 30 and the finger insertion recesses 32 are formed with a length L of 30 to 40 cm at a height H of from 80 to 100 cm from the floor.

According to the present embodiment, the first and second doors 22, 24 which constitute the bi-fold door 18 are each provided with the handle 30 and the finger insertion recess 32 which extends outside the handle 30, and, in addition, the handle 30 has the inclined plate portion 3402.

Accordingly, it is of course easy to find the handles 30, and it is possible to intuitively determine that the handles 30 are to be pulled with the fingers hooked thereto simply by glancing at the handles 30 and the finger insertion recesses 32.

In addition, since the handles 30 and the finger insertion recesses 32 in the first and second doors 22, 24 are formed to be bilaterally symmetrical, it is possible for both right-handed people and left-handed people to determine the direction in which fingers are to be inserted at a glance.

Next, a second embodiment will be described with reference to FIGS. 4A to 6B. Note that positions and members identical to those of the first embodiment are assigned identical reference numerals, and detailed descriptions thereof are omitted.

In the second embodiment, the shapes of the handles are different from those in the first embodiment.

The handle structure of the second embodiment also includes a handle 40 and finger insertion recess 42 which are provided in each of the first and second doors 22, 24.

The handles 40 are respectively provided at positions on the outer surfaces 26A near one end faces 2202, 2402.

The handles 40 are each provided with a finger-hook plate piece 44 which extends vertically while protruding from the vicinity of the respective one end face 2202, 2402 on the outer surface 26A toward the respective other end face 2204, 2404. That is, the handles 40 are provided with the finger-hook plate pieces 44 which extend vertically while protruding from ends on the outer surfaces 26A of the one end faces 2202, 2402 toward the other end faces 2204, 2404.

Figure 6A:
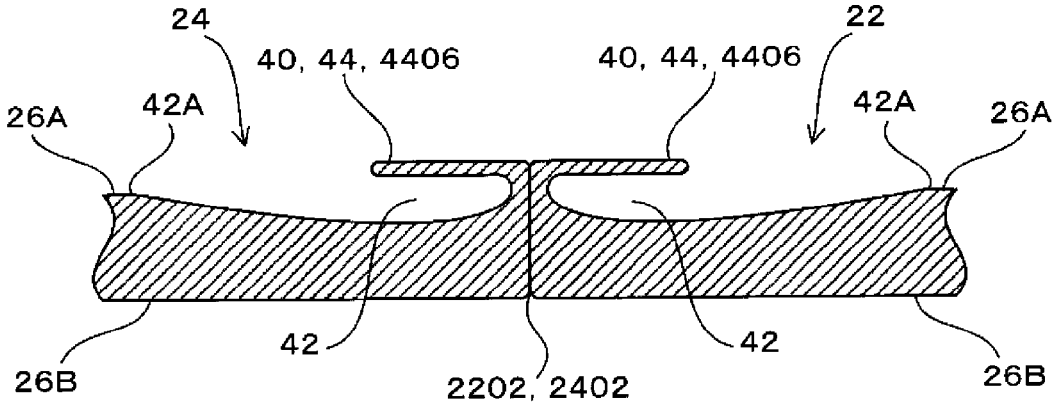
FIG. 6A is a cross-sectional view along a line A-A in FIG. 5B
Figure 6B:
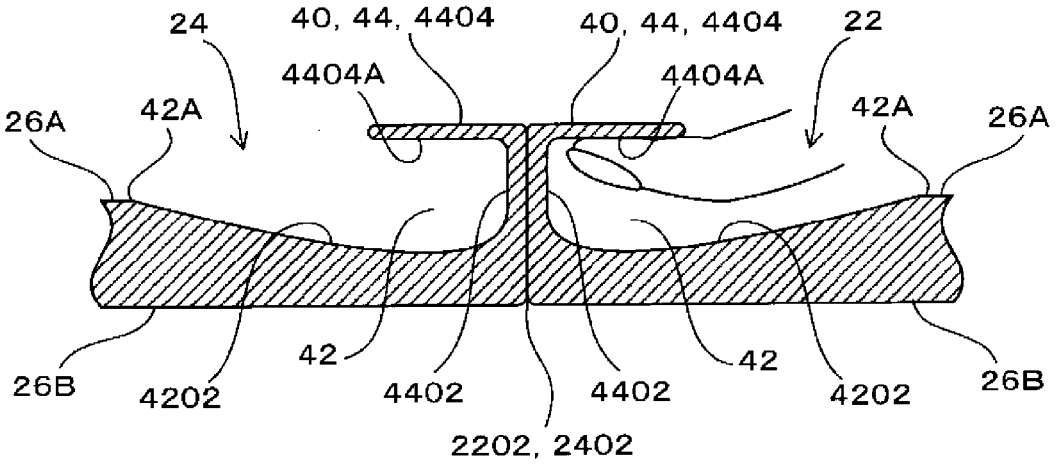
FIG. 6B is a cross-sectional view along a line B-B in FIG. 5B.

In more detail, as illustrated in FIG. 6B, intermediate portions excluding upper and lower ends of the finger-hook plate pieces 44 have erected plate portions 4402 which are erected along the one end faces 2202, 2402 in the thickness direction of the first and second doors 22, 24, and parallel plate portions 4404 which are bent from the leading ends of the erected plate portions 4402 so as to be parallel with the outer surfaces 26A at a position away from the outer surfaces 26A and extend vertically with a fixed width W.

As illustrated in FIG. 6A, the upper and lower ends of the finger-hook plate pieces 44 are formed by connecting plate portions 4406 which are gradually erected from the outer surfaces 26A and connect the outer surfaces 26A with the erected plate portions 4402 and the parallel plate portions 4404. Note that the reference numerals 4406A in FIGS. 4A to 5B indicate positions of the starting points at which the connecting plate portions 4406 are erected from the outer surfaces 26A.

On the other hand, the finger insertion recesses 42 are formed on the outer surfaces 26A of the first and second doors 22, 24 so as to face the finger-hook plate pieces 44.

In the intermediate portions excluding upper and lower ends of the finger insertion recesses 42, an interval between inner surfaces 4404A of the parallel plate portions 4404 which are positioned to face the finger insertion recesses 42 and bottom surfaces 4202 of the finger insertion recesses 42 is formed with dimensions which enable fingers to be inserted on the inner surfaces 4404A of the parallel plate portions 4404 and to be hooked on the inner surfaces 4404A of the parallel plate portions 4404 as illustrated in FIG. 6B.

The upper and lower ends of the finger insertion recesses 42 are formed with shapes which are gradually hollowed from the outer surfaces 26A and connect with the intermediate portions. Note that, in the diagrams, the reference numerals 42A indicate positions of the starting points at which the finger insertion recesses 42 start to be hollowed out from the outer surfaces 26A.

Then, in a case where the outer surfaces 26A of the first and second doors 22, 24 are viewed from the front, the finger insertion recesses 42 are formed up to positions outside of the contours of the finger-hook plate pieces 44.

The handles 40 and the finger insertion recesses 42 are formed in a bilaterally symmetrical shape with the one end faces 2202, 2402 in the center.

Figure 4B:
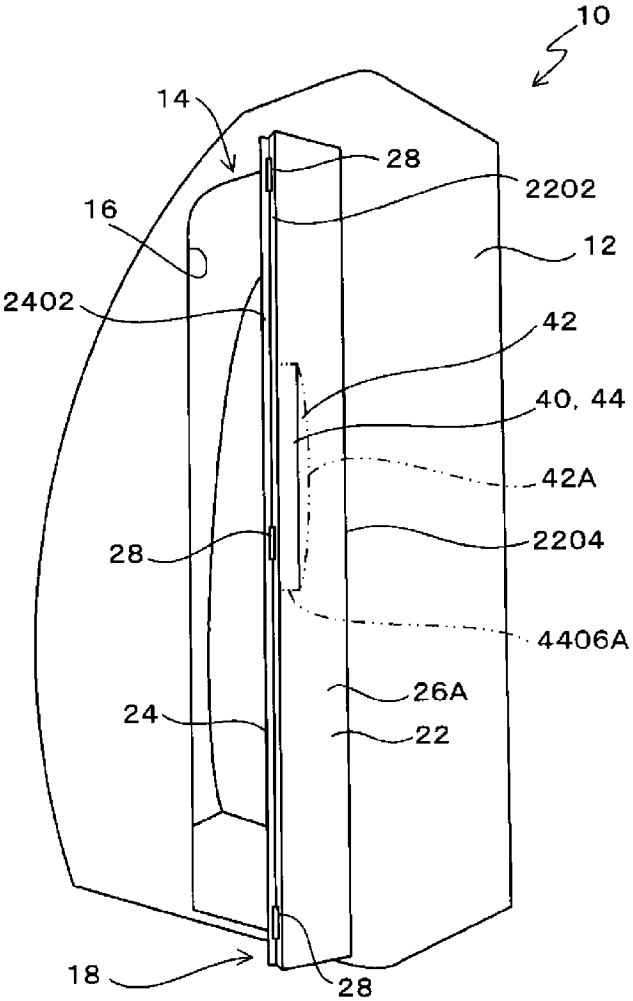
FIGS. 4A and 4B are perspective views of a lavatory unit for an aircraft to which a handle structure of a bi-fold door of a second embodiment is applied.
Figure 4A:
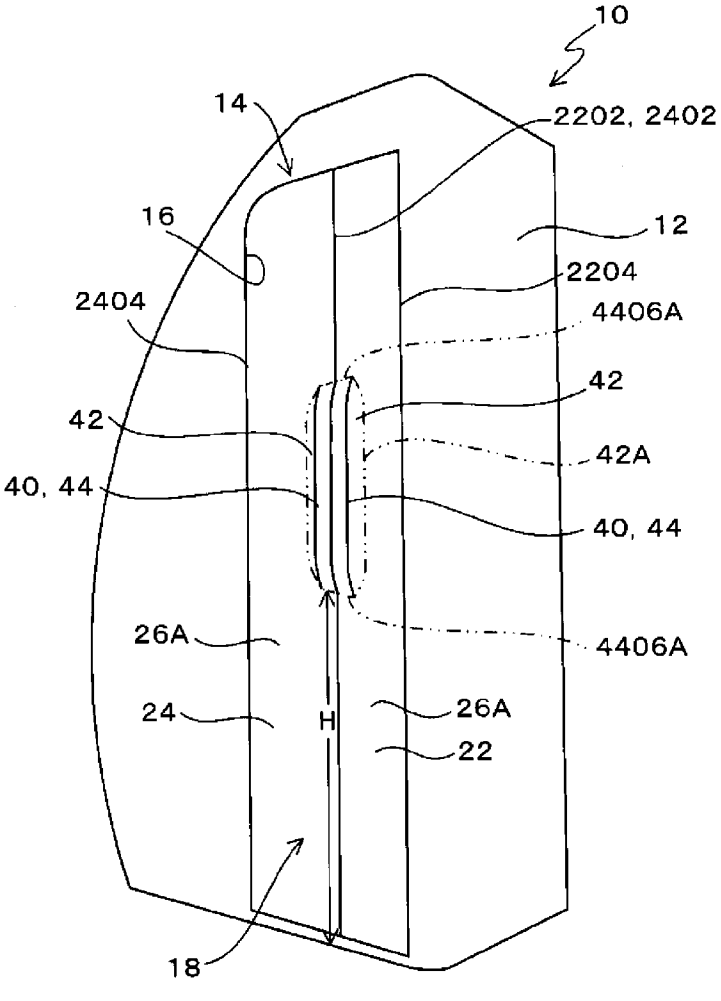
Figure 5A:
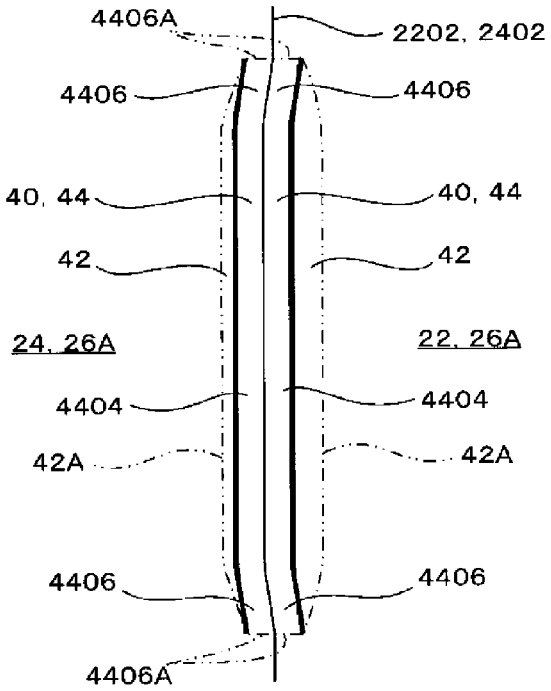
FIG. 5A is an enlarged perspective view of handles and finger insertion recess portions.
Figure 5B:
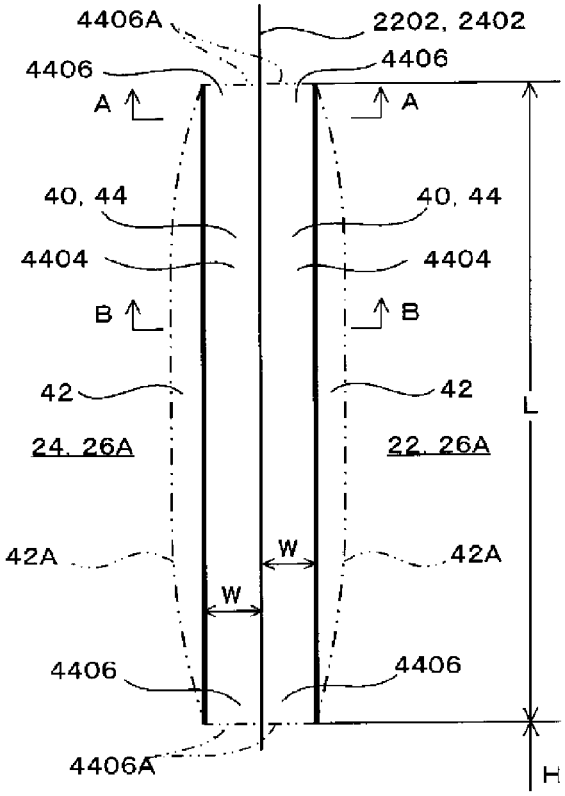
FIG. 5B is a front view of the handles and the finger insertion recess portions.

In the present embodiment, as illustrated in FIG. 4A and FIG. 5B, the handles 40 and the finger insertion recesses 42 are formed with a length L of 30 to 40 cm at a height H of from 80 to 100 cm from the floor.

According to the present embodiment, the first and second doors 22, 24 which constitute the bi-fold door 18 are each provided with the handle 40 and the finger insertion recess 42 which extends outside the handle 40.

Accordingly, it is of course easy to find the handles 40, and it is possible to intuitively determine that the handles 40 are to be pulled with the fingers hooked thereto simply by glancing at the handles 40 and the finger insertion recesses 42.

In addition, since the handles 40 and the finger insertion recesses 42 in the first and second doors 22, 24 are formed to be bilaterally symmetrical, it is possible for both right-handed people and left-handed people to determine the direction in which fingers are to be inserted at a glance.

Note that, in the present embodiment, description has been given of a case of application to the bi-fold door 18 which opens and closes the entrance 14 of the lavatory unit 10 for an aircraft. However, the opening part 16 in the present technology is a broad concept which includes opening parts for closets or storage shelves in addition to of course including the entrance 14 and may be widely applied to bi-fold doors which open and close opening parts.

What is claimed is:

1. A structure including a bi-fold door and handles, in which the bi-fold door comprises two rectangular-plate-shaped doors, each of the two rectangular-plate-shaped doors having first and second end faces at ends in a direction of a width of the bi-fold door, the two rectangular-plate-shaped doors being bendably joined together at the first end faces, each of the two rectangular-plate-shaped doors having an outer surface, and the two rectangular-plate-shaped doors being configured to fold in a V-shape at the first end faces toward an outside of the outer surfaces so as to open an opening part, on each of the two rectangular-plate-shaped-doors:

the handle and a finger insertion recess are provided together at a position on the outer surface near the first end face, the handle and the finger insertion recess being formed integrally with the rectangular-plate-shaped door;

the handle is provided with a finger-hook plate piece in which the handle extends in longitudinal direction of the rectangular-plate-shaped door on the outer surface at the first end faces;

the finger insertion recess is provided on the outer surface of the rectangular-plate-shaped door so as to face the finger-hook plate pieces;

an interval between an inner surface of the finger-hook plate piece which faces the finger insertion recess and a bottom surface of the finger insertion recess being formed with dimensions which enable fingers to be hooked on the inner surface of the finger-hook plate pieces;

as viewed from a front of the rectangular-plate-shaped door, the bottom surface of the finger insertion recess is formed up to a position outside of a contour of the finger-hook plate piece, except at positions at upper and lower ends of the finger-hook plate piece, and is connected to the outer surface of the rectangular-plate-shaped door; and the bottom surface of the finger insertion includes an inclined surface area, wherein a depth of the finger insertion recess in a direction of the width of the rectangular-plate-shaped door gradually increases toward the first end face;

wherein the handle and the finger insertion recess provided in the one of the rectangular-plate-shaped doors and the handle and the finger insertion recess provided in the other one of the rectangular-plate-shaped doors are formed in a bilaterally symmetrical shape with the respective first and faces as a center.

2. The structure according to claim 1, wherein in each of the rectangular-plate-shaped doors, the finger-hook plate piece includes the upper and lower ends and an intermediate portion between the upper lower ends, the intermediate portion being formed by an inclined plate portion inclining with respect to the outer surface, the finger-hook plate piece extends in a longitudinal direction of the rectangular-plate-shaped with a fixed width, and inclines away from the outer surface as the inclined plate portion extends away from the first end face, and the upper and lower ends of the finger-hook plate piece are formed by connecting plate portions which connects the outer surface with the inclined plate portion.

3. The structure according to claim 1, wherein in each of the rectangular-plate-shaped doors, the finger-hook plate piece includes the upper and lower ends and an intermediate portion between the upper and lower ends, the intermediate portion being formed by an erected plate portion which is erected along the first end face in the thickness direction of the rectangular-plate-shaped door and a parallel plate portion which is bent from a leading end of the erected plate portion, so as to be parallel with the outer surface at a position away from the outer surface and extends in a longitudinal direction of the rectangular-plate-shaped door with a fixed width, and the upper and lower ends of the finger-hook plate piece are formed by connecting plate portions which connect the outer surface with the erected plate portion and the parallel plate portion.

* * * * *